United States Patent [19]

MacMillan

[11] 4,001,976

[45] Jan. 11, 1977

[54] APPARATUS FOR CLEANING CASTING

[75] Inventor: William Robertson MacMillan, Sale, England

[73] Assignee: Wheelabrator-Frye, Inc., Mishawaka, Ind.

[22] Filed: June 23, 1975

[21] Appl. No.: 589,600

[52] U.S. Cl. ..... 51/9 R; 51/14

[51] Int. Cl.[2] ..... B24C 3/14; B24C 3/18

[58] Field of Search ..... 51/5 R, 8 BR, 9 R, 14, 51/15, 319, 320, 321

[56] References Cited

UNITED STATES PATENTS

| | | | |
|---|---|---|---|
| 587,892 | 8/1897 | Walter | 51/319 X |
| 2,204,636 | 6/1940 | Turnbull | 51/14 X |
| 2,887,826 | 5/1959 | Schultz | 51/9 |
| 3,690,066 | 9/1972 | Rowe | 51/9 |
| 3,793,780 | 2/1974 | Musschoot | 51/14 |
| 3,829,029 | 8/1974 | Carpenter | 51/9 X |

*Primary Examiner*—Gary L. Smith
*Attorney, Agent, or Firm*—McDougall, Hersh & Scott

[57] ABSTRACT

An apparatus is disclosed for removing molding sand from a cast part. The apparatus includes an open framework vibratory mechanism for causing movement of the molded parts through a tunnel-like member. This movement shakes and jolts the parts to loosen sand and free it from the casting. Also provided are particulate blasting means located at strategic positions in the tunnel enhancing removal of the mold sand.

5 Claims, 8 Drawing Figures

APPARATUS FOR CLEANING CASTING

BACKGROUND OF THE INVENTION

This invention relates to short blasting machines for treatment of cast parts and, in particular, the removal of the sand molds. It has been generally accepted in the casting industry that the removal of sand both externally and internally from a casting is best achieved by vibratory equipment wherein the casting is shaken and jolted to loosen the sand and free the casting from the mold. Blast cleaning equipment has also been developed which performs a similar function by utilization of high velocity impacts of particulate such as steel shot, grit and the like. Both the vibratory and blast cleaning equipment have the drawback that they cannot remove sand from intricate passages or cores in the castings, particularly where these passages have very small access holes through which the sand must be removed.

In such instances, the general practice is to rap the casting with a hammer manually and then turn the casting to permit the loosened sand to drain out. It is an object of the present invention to overcome the necessity for such manual labor in the removal and cleaning of castings.

Accordingly, it is an object of the present invention to provide a machine which subjects the cast part to vibratory and blasting action whereby an improved result is obtained from the combined action of vibratory and impact treatment of the part for sand removal.

It is another object of the present invention to provide a vibratory blasting device in conjunction with shot blasting whereby the cast part which is treated automatically turned in a manner so as to permit removal of sand through small access passages in the casting.

Other objects and advantages of the invention will become apparent from the remaining portion of the specification.

DETAILED DESCRIPTION

A device according to the invention comprises a vibrating conveyor, the walls of which are made of spaced apart bars set in a form which approximates the shape of a workpiece to be treated.

Movement of the parts through the device is achieved by a vibratory drive and the extent of the action in any plane is determined by the frequency, amplitude and angle of mounting of the drive motor which effects vibration. The vibrating conveyor extends, at either end, out from under a closed chamber which is utilized to constrain flying abrasive from the impellors which are utilized for hurling particulate at the parts. Spent abrasive passes into a recirculating system which removes the contaminants therefrom and passes it into a storage hopper for reuse by the impellor means.

The abrasive impellors may be of an air-powered or airless type as desired. Preferably, the impellors may be of an airless, centrifugal type manufactured by Wheelabrator-Frye Inc. of Mishawaka, Ind. The abrasive impellors are attached to the walls of the confining chamber and spaced in such a relationship that the abrasive streams are directed at the required apertures in the workpiece to which the sand mold may be struck. Where desirable, the abrasive stream from the impellors may be constrained by guide plates so arranged as to focus the abrasive into a small area to either clean the work more efficiently or reduce the wear and tear on the machine where a blast is not needed for cleaning a particular shape of workpiece.

As the parts move on the vibrating conveyor, the abrasive blast passes through the longitudinal clearances between the bars which form the conveyor or, where necessary and desirable, through holes cut into the tunnel wall. These clearances can be arranged wherever desired depending upon the type of part to be processed through the tunnel. The combined action of the high velocity of abrasive stream together with the jolting action of the vibratory tunnel loosen, break up and finally shake out the molding core.

The effectiveness of this double action depends upon the orientation of the workpiece with respect to the axis of vibration and with respect to the location of the blast streams. The workpiece can be turned on or more times through varying angles during its passage through the device by means of the bars being displaced axially along their length.

Figure 1:
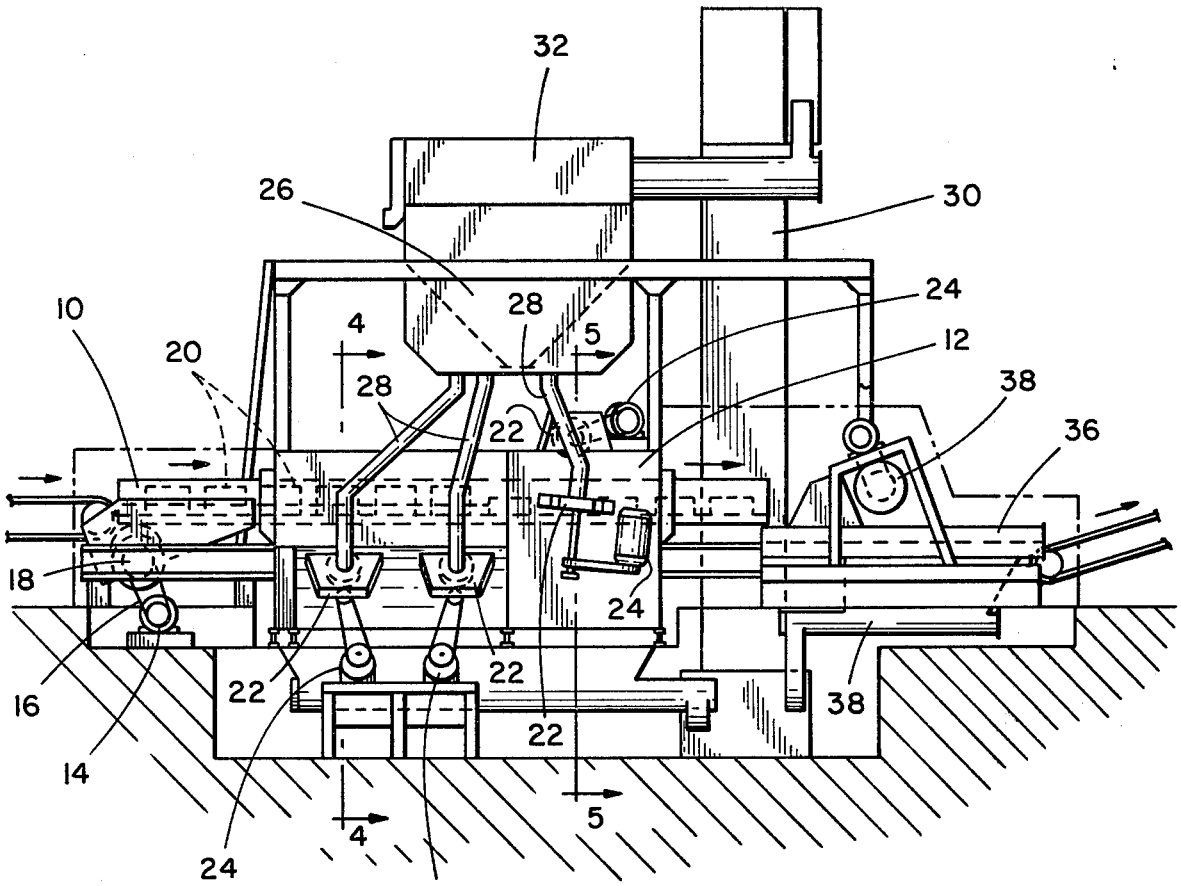
FIG. 1 is a front elevation of an apparatus according to the present invention.
Figure 2:
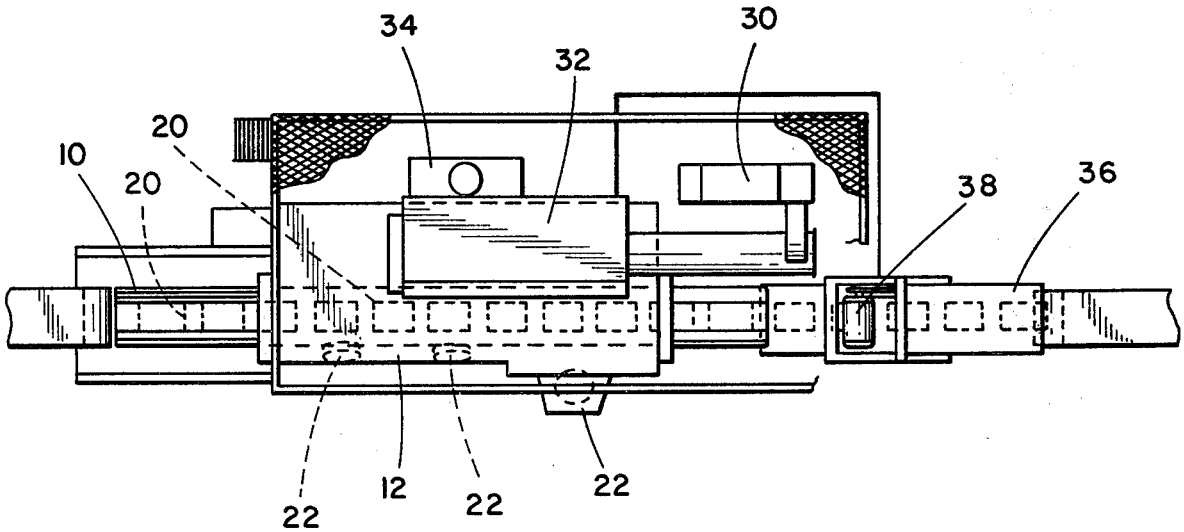
FIG. 2 is a plan view of the device of FIG. 1.
Figure 3:
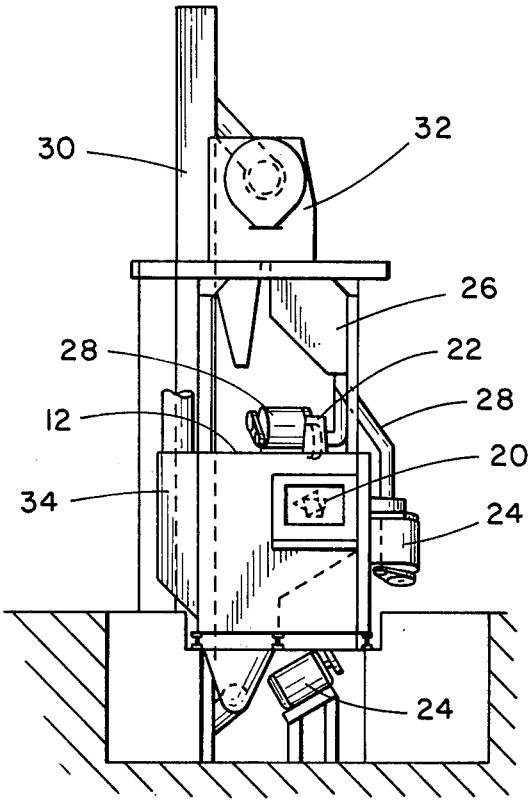
FIG. 3 is an end elevation of the FIG. 1 device.

Referring now to the drawings, a specific embodiment of the invention is illustrated. Vibratory conveyor 10 extends outwardly at both ends thereof from a blasting chamber 12, provided to confine abrasive therein. The vibrating conveyor 10 is driven by a conveyor motor 14 which is connected through a pulley 16 to a vibratory arrangement 18. The motor 14 is thus responsible for imparting vibratory motion to parts 20 which are placed on the conveyor 10, thereby causing them to move to the right as illustrated in FIG. 1.

Positioned in the blast housing 12 at various orientations and locations are a plurality of abrasive blasting wheels 22. Each wheel 22, driven by a motor 24, receives an abrasive supply from a supply hopper 26 via feed chutes 28. The castings 20 are subjected to an abrasive blast as they move through the blast housing 12 on the vibratory conveyor 10.

Spent abrasive collects at the bottom of the blast housing 12 where it is picked up by a screw conveyor and returned to the supply hopper 26 by a belt and bucket elevator 30. Interposed between the elevator 30 and the supply hopper 26 is an air wash separator 32 of conventional design. Such a separator is capable of separating abrasive from debris picked up during the blasting process and returning the abrasive to the hopper 26 for reuse while disposing of the debris as appropriate. A dust collector 34 is desirably incorporated in the air wash separator.

After the parts 20 have passed through the blast housing 12 on the vibrating conveyor 10, they drop onto a second conveyor 36 driven by drive motor 38. Conveyor 36 is a shot removal conveyor wherein any shot which is still on the parts is shaken loose and drops downwardly to a screw conveyor 38 connecting with the elevator 30.

Figure 4:
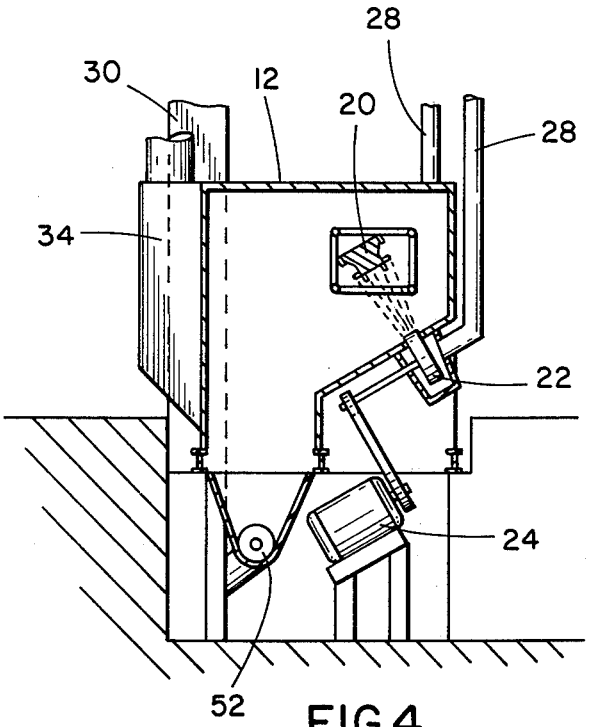
FIG. 4 is a sectional view along the lines 4—4 of FIG. 1.
Figure 5:
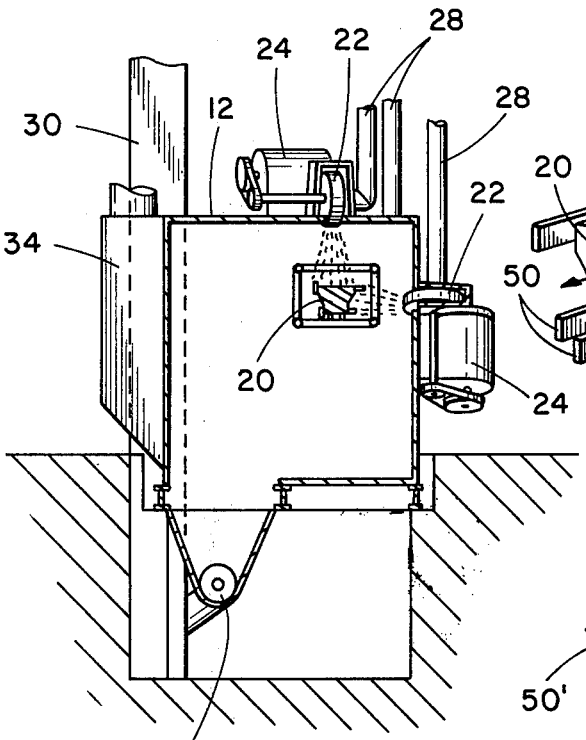
FIG. 5 is a similar sectional view along the lines 5—5 of FIG. 1.
Figure 6:
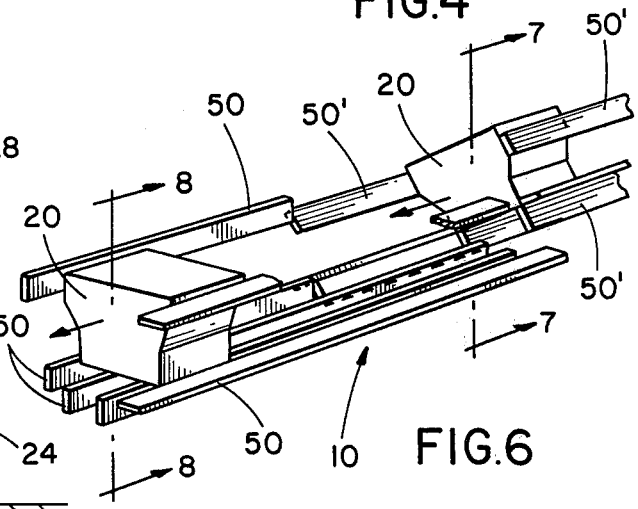
FIG. 6 is an enlarged perspective view illustrating the movement of cast parts through the device and indicating the manner in which the position of the parts through the device is changed.
Figure 7:
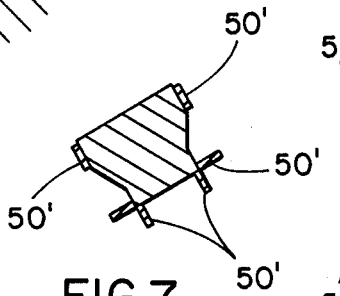
FIGS. 7 and 8 are views taken along the respective section lines of FIG. 6.
Figure 8:
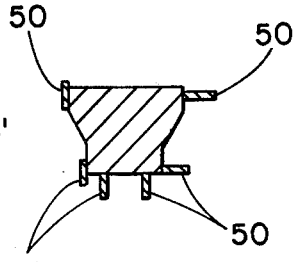

Referring to FIGS. 4–8, the details of the vibrating conveyor 10 can be seen. Specifically, in FIG. 6, the frame members which make up the vibrating conveyor 10 are illustrated. A part 20 is supported on the vibrating conveyor 10 on a plurality of frame members 50. The frame members are arranged so as to conform to the part which will pass therethrough, while at the same time permitting access so that particulate treatment of the parts may be achieved through the space between adjacent members. As is indicated in FIG. 6, the orientation of the part 20 as it moves through the vibratory conveyor 10 can be changed by changing the spacing and location of the support members 50. Thus, the support members may be arranged as illustrated at 50' causing the part to be maintained at an acute angle to the vertical for effecting blast treatment on different portions of the part.

As indicated in FIGS. 4 and 5, spent abrasive passes downwardly to the bottom of the blast housing 12 where it is conveyed by screw conveyor 52 to the boot of the belt and bucket elevator 30. After the passage of the parts through the vibrating conveyor 10, the parts pass outwardly from the blast housing 12 where they drop downwardly onto the shot removal conveyor 36. Here they are subjected to additional vibration effective for removing any remaining shot.

While I have shown and described embodiments of this invention in some detail, it will be understood that this description and accompanying illustrations are offered merely by way of example, and that the invention is to be limited in scope only by the appended claims.

I claim:

1. A device for removing mold sand from castings comprising:

a. an open framework vibratory conveyor receiving said castings and subjecting them to a jolting action to loosen and break up said sand;

b. a blast enclosure disposed about at least a portion of said conveyor; and c. blasting means mounted to said enclosure for throwing particulate at said castings through said open framework to enhance and accelerate the breakup and removal of sand by said vibratory conveyor, said open framework conveyor including a plurality of spaced bars which support and guide said casting, and wherein the configuration of said bars changes to alter the spatial orientation of the castings thereby to subject a greater portion of the castings to the blast means.

2. The device according to claim 1 wherein said blast means throws particulate at said casting through the spaces between adjacent bars.

3. The device according to claim 1 further including a second vibratory conveyor for receiving the treated castings, said conveyor effecting removal of spent particulate from the castings.

4. The device of claim 1 wherein the device further includes means for collecting spent particulate and debris, and means for separating the particulate from said debris whereby the particulate is recirculated to the blasting means for reuse.

5. The device of claim 1 wherein said blasting means are airless centrifugal blasting wheels.

* * * * *